United States Patent [19]

Brusa et al.

[11] 3,961,890

[45] June 8, 1976

[54] METHOD FOR WASHING ACRYLIC FILAMENTS

[75] Inventors: Bruno Brusa; Camillo Panozzo, both of Mestre (Venezia); Giovanni Zanini, Valdagno (Vicenza), all of Italy

[73] Assignee: Montefibre S.p.A., Milan, Italy

[22] Filed: Nov. 26, 1974

[21] Appl. No.: 527,260

[30] Foreign Application Priority Data

Nov. 29, 1973 Italy ..... 31930/73

[52] U.S. Cl. ..... 8/137.5; 264/38; 264/182

[51] Int. Cl.[2] ..... D01F 6/18; D06L 3/16; D06M 3/18; D06M 3/20

[58] Field of Search ..... 8/137.5; 264/38, 182

[56] References Cited

UNITED STATES PATENTS 3,318,983 5/1967 Hovis et al. ..... 264/38

3,558,765 1/1971 Bruner et al. ..... 8/137.5

*Primary Examiner*—Allan Lieberman

*Attorney, Agent, or Firm*—Stevens, Davis, Miller & Mosher

[57] ABSTRACT

An improved method for washing acrylic filaments in which the acrylic filaments are produced by wet-spinning a solution of an acrylic polymer in dimethylacetamide, and are coagulated, and if desired stretched, and are then finally washed with an aqueous wash solution containing an alkaline agent, wherein the aqueous wash solution contains acetic acid in a quantity between 0.0050% and 0.1% and dimethylamine in such a quantity that the dimethylamine/acetic acid molar ratio is greater than 0.2, and preferably between 0.4 and 0.8.

4 Claims, No Drawings

METHOD FOR WASHING ACRYLIC FILAMENTS

The present invention relates to an improved method for washing and neutralizing acrylic filaments. More particularly, this invention relates to an improved method for washing filaments produced by the wet spinning of a solution of an acrylic polymer in an organic solvent such as dimethylacetamide.

As is well known, in the wet spinning of acrylic polymers the polymer solution (also called dope) is extruded through a spinneret directly into a coagulation bath generally consisting essentially of a mixture of the spinning solvent and water.

Subsequently, the filaments thus obtained are subjected to an intensive washing with water, generally conducted in a countercurrent in order to eliminate the solvent that the individual filaments drag along with them upon leaving the coagulation bath.

In order to remove the acidity generally present in or associated with the filaments—the acidity being due partly to the acid groups present in the polymeric chain and partly to the free acid present in the spinning solvent—it is well known to add to the wash water an alkaline agent in a quantity sufficient to neutralize the free acidity. As neutralizing agent, a bicarbonate of an alkaline metal is generally used, e.g., sodium bicarbonate.

Such a neutralizing agent in practice, however, has the drawback of having continuously to be metered in relation to the free acid groups present in the filaments, which, in their turn, depend on the course of the spinning operation.

In fact, it has been found that in practice an excess of the bicarbonate with respect to that necessary for stoichiometrically neutralizing the acid groups causes yellow spots on the filaments, while too little bicarbonate causes a non-uniform dyeability of the fiber.

Thus, a principal object of this invention is that of providing an alkalizing agent that may be admixed with the wash water and which will not have the above-mentioned drawbacks.

More particularly, an object of this invention is that of providing an alkalizing agent which, when added to the wash water, will neutralize the acidity present in the filaments as well as wash the latter with the formation of easily removable salts.

It has now, surprisingly, been found that these and other objects are attained by carrying out the washing and simultaneous neutralization of the filaments with water containing acetic acid in a quantity between 0.0050% and 0.1%, partially neutralized with dimethylamine.

More particularly, the quantity of dimethylamine to be added to the wash water is such that the molar ratio of added dimethylamine to total acetic acid is greater than 0.2.

Molar ratios between 0.4 and 0.8 are in practice, preferred inasmuch as they bring about the best results most economically.

In the following Table the influence of the dimethylamine on the residual acidity contained in the washed filaments is clearly evidenced. The acidity in the filaments is expressed in percent by weight of acetic acid present in the filaments and is determined by titration with NaOH of the aqueous extract obtained by subjecting the filaments to boiling in water for 30 minutes.

TABLE

| Acetic acid contained in wash water, in p.p.m. | Added dimethylamine, in p.p.m. | Molar ratio dimethylamine/acetic acid | pH | Acidity in the filaments |
|---|---|---|---|---|
| 200 | 15 | 0.1 | 4.2 | 0.150 |
| 200 | 75 | 0.5 | 4.8 | 0.006 |
| 200 | 150 | 1.0 | 9.2 | 0.006 |

As will be seen from the above-recorded results, by operating with molar ratios of dimethylamine/acetic acid lower than 0.2, insufficiently neutralized filaments are obtained. This does not occur when operating with ratios higher than this minimum value.

The tests reported in the Table were carried out by operating as described in the example given below.

The upper limit of the dimethylamine to be added to the wash water is not critical and may be such that the molar ratio of dimethylamine/acetic acid is even higher than 1. Such higher ratios are, however, discouraged in practice inasmuch as they involve a useless waste of dimethylamine without achieving any further advantage.

The above-mentioned aqueous wash solution displays a very high effectiveness inasmuch as, even though its pH is less than 7 and it contains free acid, it brings about a complete neutralization of the filaments.

According to a non-limiting interpretation of what is believed to occur, the effect seems to be due to the very close affinity of the resulting dimethyl-ammonium ion with the polymer making up the filaments. It has also been observed in practice that the total quantity of salts present in the water used for the washing and the neutralization is not critical, provided the above-indicated dimethylamine/acetic acid molar ratio is employed.

The fact that it is possible to neutralize the fiber with an acid solution makes superfluous the further washing with water that is normally carried out to remove the neutralizing agent as, on the contrary, happens when sodium bicarbonate is used as a neutralizer.

Another advantage in the use of dimethylamine as a neutralizing agent is the fact that in the filament drying stage no ill-smelling fumes are freed, as on the contrary happens when ammonia and other nitrogenous bases are used for neutralization.

Still further advantages resulting from the use of the above-mentioned aqueous solution in the washing and neutralization of the acrylic filaments reside in the fact that one may use the same water that comes from the spinning solvent recovery system, for example in the case of dimethylacetamide as solvent. Said water, in fact, contains small quantities of acetic acid resulting from the hydrolysis of the dimethylacetamide in the distillation stage.

It is thus sufficient to meter into the processing water small quantities of dimethylamine in order to directly obtain a very dilute solution with which it is possible to carry out contemporaneously the desired washing and neutralization of the filaments.

Finally, the fact must be stressed that the dimethylammonium acetate which forms in the wash water may be reconverted to dimethylacetamide during the recovery of the solvent via distillation. In this way pollution and the discharge of noxious process byproducts are avoided.

The term "acrylic polymer" as used herein includes not only homopolymer of acrylonitrile but also copolymers and mixtures thereof, and particularly those containing at least 80% by weight of polymerized or copolymerized acrylonitrile.

For instance, the polymer may be a copolymer containing from 80% to 98% of acrylonitrile and 2% to 20% of another copolymerizable mono-olefinic monomer. Suitable copolymerizable monoolefinic monomers include acrylic, alpha-chloro-acrylic and methacrylic acids; acrylates and methacrylates such as methylmethacrylate, ethyl-methacrylate, butyl-methacrylate, methoxymethyl methacrylate; beta-chloroethyl methacrylate and the corresponding esters of acrylic and alpha-chloroacrylic acids; vinyl chloride; vinyl fluoride; vinyl bromide; vinylidene chloride; 1-chloro-1-bromo-ethylene; methacrylonitrile; acrylamide and methacrylamide; alpha-chloro-acrylamide or their monoalkyl substituted derivatives; methyl-vinylketone; vinyl esters such as vinyl acetate, vinyl chloroacetate, vinyl propionate and vinyl stearate; methylenmalonic esters; itaconic acid and its esters; vinylfurane; alkylvinyl esters; vinylsulphonic acid; ethylene-alpha-beta-dicarboxylic acids or their anhydrides or derivatives such as diethyl citraconate, diethyl mesaconate; styrene, vinyl-naphthalene; sulphonic acids having an ethylenically unsaturated link and corresponding salts and other copolymerizable mono-olefinic monomers.

The polymer may also be a copolymer obtained by the copolymerization of acrylonitrile with two or more of any of the above-listed monomers other than acrylonitrile.

While the preferred polymers used in this invention are those containing at least 80% acrylonitrile, and in general known as fiber-forming acrylic polymers, it is nevertheless to be understood that the invention may likewise be applied to polymers, copolymers and mixtures of polymers containing even less than 80% acrylonitrile and even as little as 35% acrylonitrile, provided they are soluble in dimethylacetamide.

The following detailed working example is given for the purpose of even more clearly illustrating the inventive idea of this invention.

EXAMPLE

The polymer used in this example was a copolymer consisting of 92.8% by weight of acrylonitrile and 7.2% by weight of vinyl acetate, having a specific viscosity of 0.145 and 35 microequivalents/g of end acid groups and obtained by carrying out the polymerization of the monomers in an aqueous suspension in the presence of a catalytic system consisting of potassium persulphate and sulphur dioxide.

1,000 g. Of polymer were added with stirring to 3,000 g of dimethylacetamide in a tank. The dimethylacetamide had an acetic acid content of 0.4% by weight and was maintained at a temperature of 5°C. The suspension thus obtained was conveyed to and through a heat exchanger heated at 80°C, in order to dissolve the polymer. It was then filtered and fed through a spinneret with 500 holes, each having a diameter of 76$\mu$.

The filaments thus obtained were coagulated in a solution containing a mixture consisting of 55% water and 45% dimethylacetamide and maintained at a temperature of 50°C.

The filaments coming out of the coagulation bath at a rate of 6 meters per minute were stretched in boiling water to 5.5 times their original length. They were then washed and neutralized with an aqueous solution of $NaHCO_3$ (0.15% of $NaHCO_3$ with respect to the fiber).

The test was carried on for several days in order to control the properties of the fiber and the variation of the properties with time.

Twenty-eight samples were drawn at different times and the following mean values of the original colors (IP), of the dyeability ($K_s$), and of the acidity of the fibers were obtained, with the following corresponding variations:

| | I.P. | $K_s$ | Acidity in percent by weight |
|---|---|---|---|
| Mean Value | 97.3 | 1.72 | 0.014% |
| Variability coefficient | 0.55 | 0.075 | 0.015% |

Moreover, the fibers showed yellow spots on the surface.

On repeating the above-mentioned procedure, but this time carrying out the washing and neutralization with an aqueous solution containing 200 p.p.m. of acetic acid and 75 p.p.m. of dimethylamine, with a molar ratio of dimethylamine/acetic acid = 0.5, the following results were obtained:

| | I.P. | $K_s$ | Acidity in percent by weight |
|---|---|---|---|
| Mean Value | 97.5 | 1.81 | 0.006% |
| Variability coefficient | 0.40 | 0.05 | 0.007% |

The fibers appeared to have a uniform color and were completely free of yellow spots.

The purity index (IP) was determined by means of a General Electric Spectrophotometric Integrator, according to the C.I.E. system for the representation and measurement of color.

The dyeability ($K_s$) is given by the quantity in percent by weight of Red Astrazon Dye BDL, absorbed by the fiber to saturation and exhaustion of the bath, multiplied by the tintorial factor of the dye (0.36). This measurement is made by calculating the percentage of dyestuff absorbed by three samples of the same fiber, after each sample has been immersed for 3 hours at 100°C in baths containing increasing quantities of dye and stronger than those necessary for saturating the fiber and in which the fiber/bath ratio is 1:50 by weight, and by subsequently extrapolating at a residual concentration zero of the bath, the three values thus obtained.

As indicated above, in accordance with the calculations leading to the molar ratio of 0.5 expressed in the example, expressions of P.P.M. and percentage are based on weight.

What is claimed is:

1. In a method for washing acrylic filaments in which acrylic filaments made from an acrylic polymer consisting essentially of acrylonitrile homopolymer or copolymer containing at least 35% of acrylonitrile, and produced by wetspinning a solution of said acrylonitrile homopolymer or copolymer in dimethylacetamide, are coagulated, with or without subsequent stretching, and are finally washed with an aqueous wash solution, the improvement wherein the aqueous wash solution contains acetic acid in a quantity between 0.0050% and 0.1% by weight and dimethylamine in such a quantity that the dimethylamine/acetic acid molar ratio is greater than 0.2.

2. A method according to claim 1, wherein the dimethylamine/acetic acid molar ratio is between 0.4 and 0.8.

3. A method according to claim 1, wherein the wash water is the water coming from the dimethylacetamide solvent recovery system.

4. A method according to claim 2, wherein the wash water is the water coming from the dimethylacetamide solvent recovery system.

* * * * *